US005094632A

United States Patent [19]

Chen et al.

[11] Patent Number: 5,094,632

[45] Date of Patent: Mar. 10, 1992

[54] CONNECTOR FOR CHRISTMAS LIGHT STRINGS AND FASTENERS THEREFOR

[76] Inventors: Sen H. Chen; Jeou N. Tseng; Jeng S. Wu, all of No. 15, Lane 167, Tung Nan St., Hsinchu City, Taiwan

[21] Appl. No.: 675,310

[22] Filed: Mar. 26, 1991

[51] Int. Cl.[5] ..... H01R 13/00

[52] U.S. Cl. ..... 439/699

[58] Field of Search ..... 439/699-702

[56] References Cited

U.S. PATENT DOCUMENTS

| | | | |
|---|---|---|---|
| 646,179 | 3/1900 | Ireland | 439/699 |
| 1,081,884 | 12/1913 | Bertagnolli et al. | 439/699 |
| 2,398,634 | 4/1946 | Geers et al. | 439/699 |

*Primary Examiner*—Joseph H. McGlynn

*Attorney, Agent, or Firm*—Zarley, McKee, Thomte, Voorhees & Sease

[57] ABSTRACT

A connector for Christmas light strings includes a wire-holding portion for receiving and holding two conducting wires and a socket-engaging portion for engaging with a conventional socket. The wire-holding portion includes two half casings each having two slots separated by a wall formed therebetween. The two half casing are formed together at one edge thereof such that the two half casings are pivotable with respect to each other. The socket-engaging portion includes an annular hollow receiving portion, a first annular protrusion, and a second annular protrusion. The annular hollow receiving portion has a compartment for receiving the wire-receiving portion.

20 Claims, 12 Drawing Sheets

CONNECTOR FOR CHRISTMAS LIGHT STRINGS AND FASTENERS THEREFOR

BACKGROUND OF THE INVENTION

The present invention relates to a connector for Christmas light strings, and more particularly to an improved connector which is engageable with any selected socket of a Christmas light string for attaching more light bulbs to the light string for decoration. The present invention also relates to a fastening means for connectors and sockets used in Christmas light strings, similar to the socket and bulb snap fasteners for Christmas light strings disclosed in U.S. Pat. Nos. 4,943,899 and 4,970,632.

U.S. Pat. No. 4,544,218 discloses a connector for electrical connection of a lighted decorative ornament in a string of conventional sockets for miniature Christmas lights or the like, in which the connector consists of two separate portion, i.e., a base member and a support member. Such a connector has been improved by combining the two portions thereof and is manufactured by injection molding. However, such an improved connector is expensive since it is integrally manufactured by injection molding. In addition, although the connector is inserted into a selected socket, it is still easily loosened and electrically disengages from the socket due to a shock or vibration since no fastener is provided.

The present invention intends to provide an improved connector with fastening means for Christmas light strings.

SUMMARY OF THE INVENTION

It is an object of the present invention to provide an improved connector for Christmas light strings.

It is another object of the present invention to provide a fastener means on the connector to provide a more secure engagement with a conventional socket.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
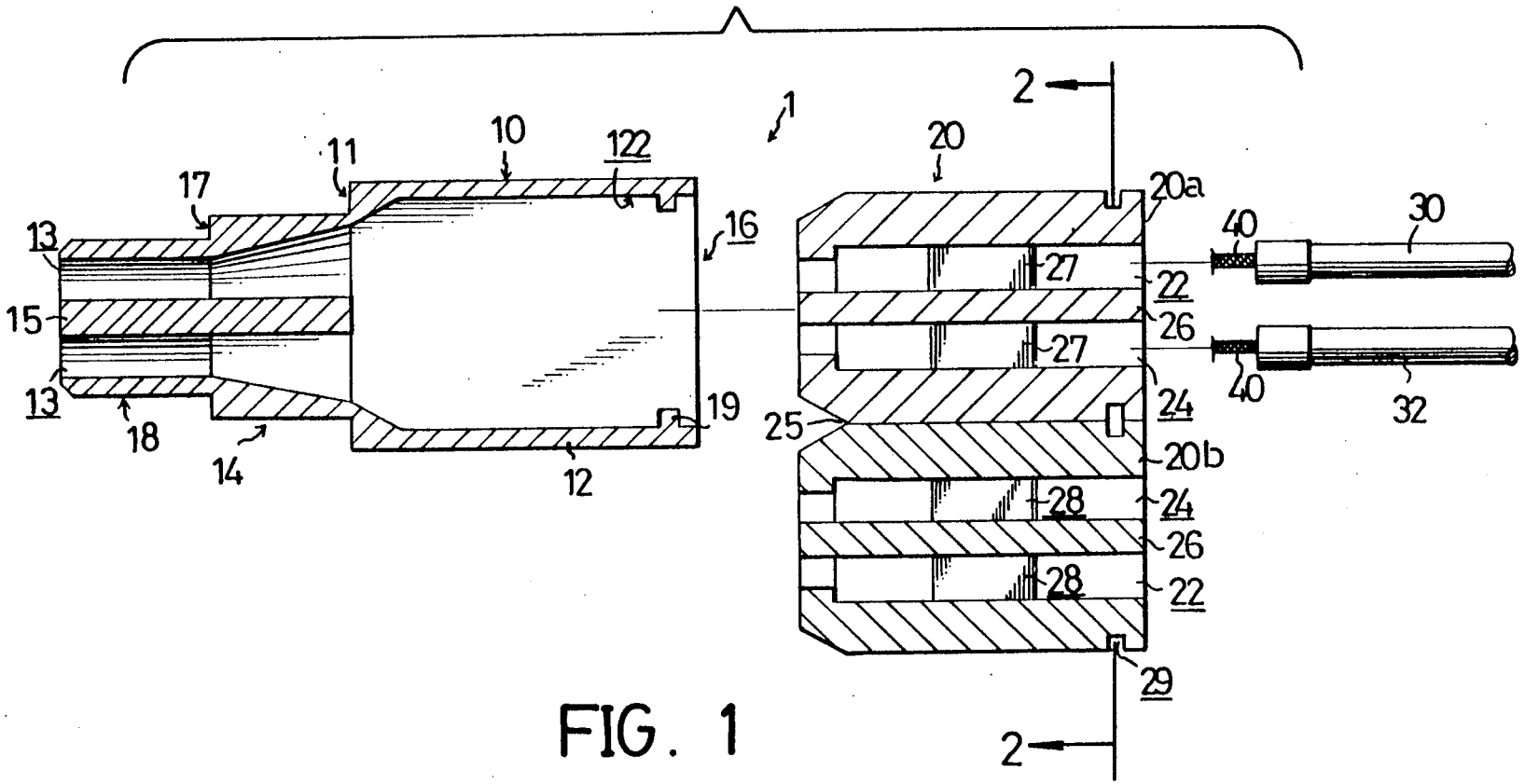
FIG. 1 is an exploded cross-sectional view of a connector in accordance with the present invention.

Referring to FIG. 1, the connector 1 according to the present invention comprises a wire-holding portion 20 for receiving and holding connecting wires 30 and 32 therein and a socket-engaging portion 10 for engaging with a conventional socket of a Christmas light string (not shown).

The socket-engaging portion 10 includes an annular hollow receiving portion 12, a first annular protrusion 14, and a second annular protrusion 18. The receiving portion 12 has a compartment 122 therein and an opening 16 at one end thereof. A first end of the first annular protrusion 14 protrudes from the other end of the receiving portion 12, thereby forming a first shoulder 11. A first end of the second annular protrusion 18 protrudes from a second end of the first annular protrusion 14, thereby forming a second shoulder 17. The receiving portion 12, the first annular protrusion 14, and the second protrusion 18 are integrally formed with insulating material.

The first annular protrusion 14 has an outer diameter less than an inner diameter of the receiving portion 12, and the second annular protrusion 18 has an outer diameter less than the outer diameter of the first annular protrusion 14. Two guiding channels 13 extend longitudinally in the first and second annular protrusions 14 and 18 to communicate with the compartment 122 of the receiving portion 12, and are separated by a wall 15, also extending longitudinally in the first and second annular protrusions 14 and 18.

Figure 1A:
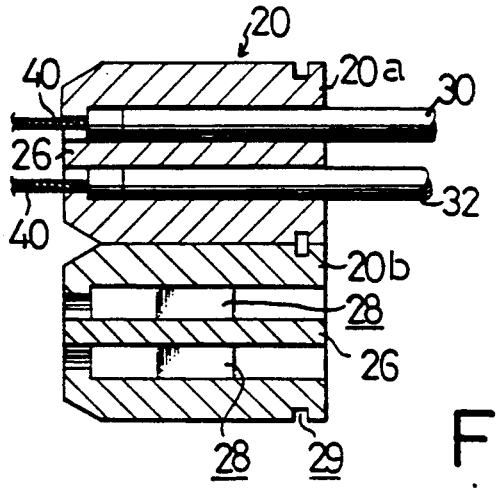
FIGS. 1*a*–1*d* show the assembly of the connector according to the present invention.
Figure 1B:
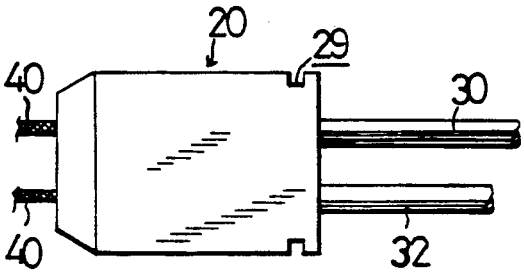
Figure 2:
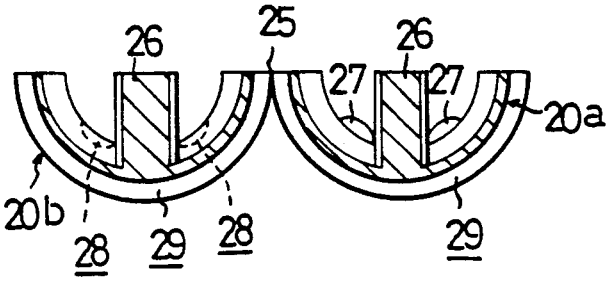
FIG. 2 is a cross-sectional view showing a wire-receiving portion of the connector according to the present invention.
Figure 2B:
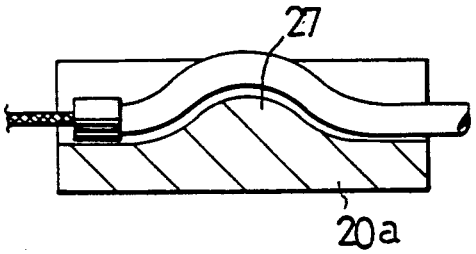
FIG. 2*b* is cross-sectional view showing a conducting wire held in the wire receiving portion.

Still referring to FIG. 1 and further to FIG. 2, the wire-holding portion 20 includes two half casings 20*a* and 20*b*, each having two slots 22 and 24 separated by a wall 26 formed therebetween. The two half casings 20*a* and 20*b* are made of insulating material, and one edge 25 of each thereof are formed together, such that the two half casings 20*a* and 20*b* are pivotable with respect to each other between a first position shown in FIG. 1*a* and a second position shown in FIG. 1*b*.

Figure 1D:
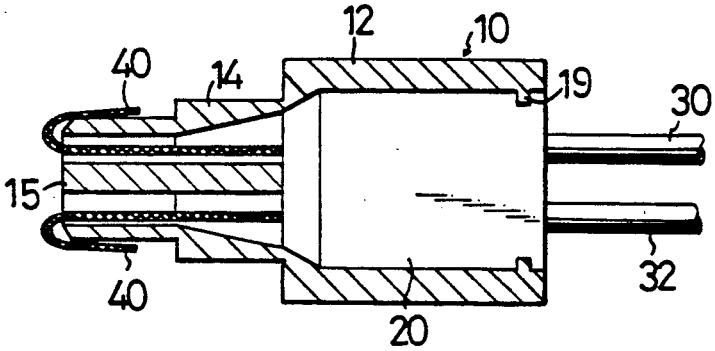
Figure 1C:
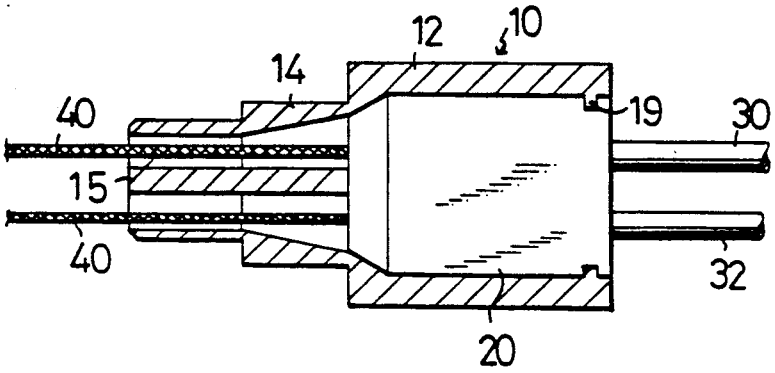
Figure 1E:
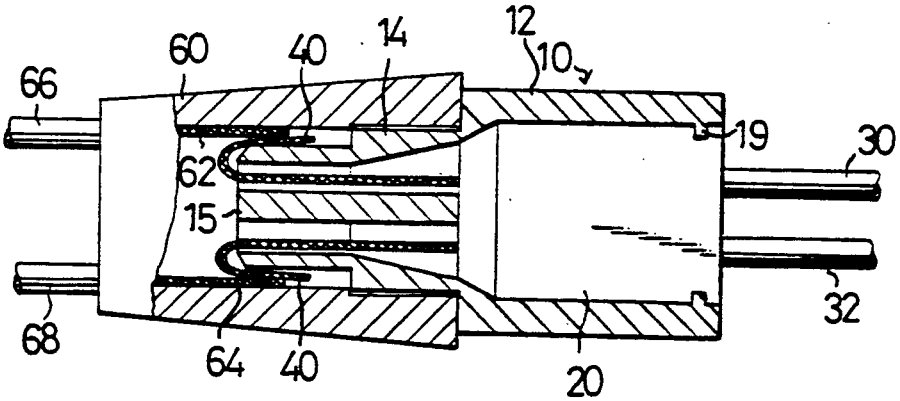
FIG. 1*e* is a partial cross-sectional view showing the engagement of the connector according to the present invention and a conventional socket.

Referring to FIGS. 1*a* to 1*e*, during assembly, the two conducting wires 30 and 32, each with a contact blade 40, are respectively placed into the slots 22 and 24 of the two half casings 20*a* and 20*b*, in a status as shown in FIG. 1*a*. The two half casings 20*a* and 20*b* are then closed to a status as shown in FIG. 1*b*. The wire-holding portion 20 is then inserted into the compartment 122 of the receiving portion 12 of the socket-engaging portion 10, with the two contact blades 40 passing through respective guiding channels 13, as shown in FIG. 1*c*. The two contact blades 40 are bent back around the outside of the second annular protrusion 18, as shown in FIG. 1*d*, for engagement with two contacts 62 and 64 of the socket 60 of the Christmas light string, wherein the contacts 62 and 64 are respectively electrically connected with wires 66 and 68 of the Christmas light string, which is conventional and no further explanation is required. FIG. 1*e* shows the engagement of the connector 1 of the present invention and a conventional socket 60 of a conventional Christmas light string, which will be discussed in detail later.

Referring to FIGS. 1 and 2*a*, in the slots 22 and 24 of the two half casings 20*a* and 20*b*, in order to retain the conducting wires 30 and 32 in the wire-holding portion 20, a protrusion 27 is formed in the slots 22 and 24 of the half casing 20*a*, and a corresponding recess 28 is formed in slots 22 and 24 of the other half casing 20*b*.

Additionally, an annular recess 29 is formed on an outer periphery of the wire-holding portion 20, and an annular flange 19 is formed on an inner periphery of the receiving portion 12 of the socket-engaging portion 10, such that when the wire-holding portion 20 is inserted into the compartment 122 of the receiving portion 12, the annular recess 29 engages with the annular flange 19 to securely retain the wire-holding portion 20 in the socket-engaging portion 10.

Figure 3:
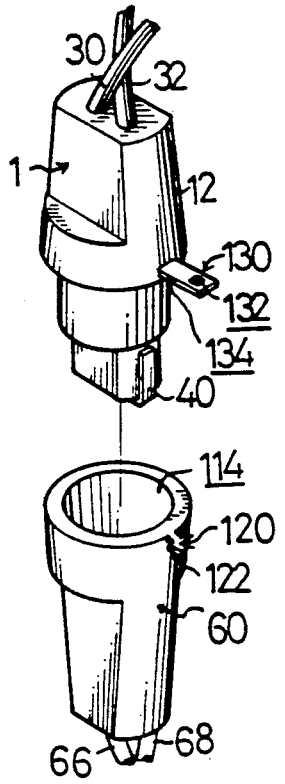
FIG. 3 is a perspective view showing a fastener on the connector for engagement with a conventional socket.
Figure 4:
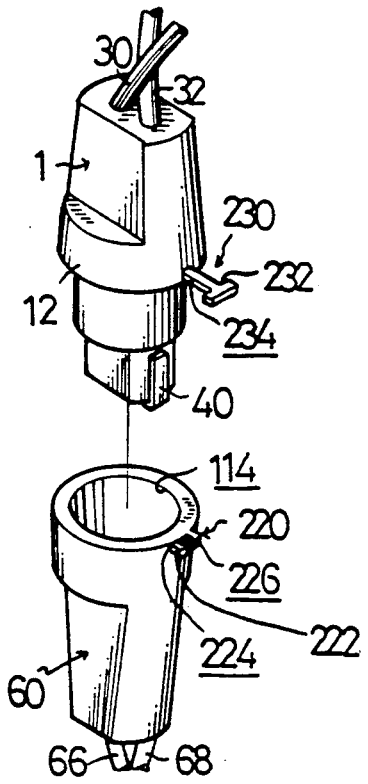
FIG. 4 is a perspective view showing another fastener on the connector for engagement with a conventional socket.
Figure 3A:
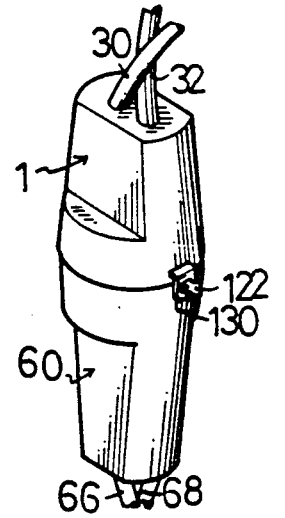
FIG. 3*a* shows the engagement of the connector and the conventional socket of FIG. 3.
Figure 5:
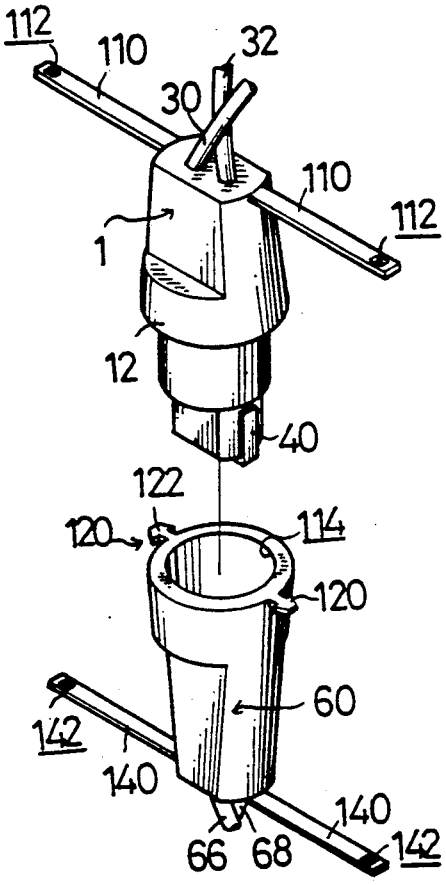
FIG. 5 is a perspective view showing yet another fastener on the connector for engagement with a conventional socket.

FIGS. 3 through 5 illustrate fastening means for the connector according to the present invention and a conventional socket 60. Referring to FIGS. 3 and 3*a*, a hole 114 is centrally formed in the socket 60 for receiving the connector 1. A T-shaped male member 120 having a snapping head 122 is formed on an upper margin of an outer periphery of the socket 60. A tongue 130 of insulating material is formed, relative to the T-shaped male member 120, on an outer periphery of the receiving portion 12 of the connector 1. A substantially rectangular slot 132 is formed on the tongue 130 adjacent to a free end thereof. The slot 132 has a width slightly less than a maximum width of the snapping head 122 of the T-shaped male member 120. A V-shaped groove 134 is formed on a lower side of the tongue 130 at an end opposite to the free end, extending transversely to a length of the tongue 130.

The slot 132 is snappable with the T-shaped male member 120 by bending the tongue 130 downward about the V-shaped groove 134 and pushing the tongue 130 against the T-shaped male member 120, such that the snapping head 122 is forced through the slot 130. Accordingly, the T-shaped male member 130 snaps into the slot 132. Alternatively, the T-shaped male member 130 can be formed on the receiving portion of the connector 1, and the tongue 130 can be formed on the outer periphery of the socket 60 without affecting the securing function.

Figure 4A:
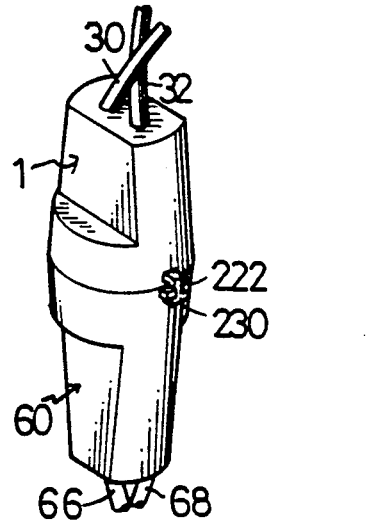
FIG. 4*a* shows the engagement of the connector and the conventional socket of FIG. 4.

FIGS. 4 and 4*a* show another embodiment of a socket and bulb snap fastener. A T-shaped tongue 230 of insulating material having a shoulder 232 is formed on the an outer periphery of the receiving portion 12 of the connector 1. A V-shaped groove 234 is formed on a lower side of the T-shaped tongue 230 at an end opposite to the free end of the tongue 230, extending transversely across a length of tongue 230. A flexible receiving means 220 of insulating material is formed, relative to the T-shaped tongue 230, on an upper margin of a periphery of the socket 60. The receiving means 220 comprises two opposite L-shaped protrusions 222 which together form a compartment 224 and a path 226 having a slightly less wide than a width of the T-shaped tongue 230.

When engaging the connector 1 and the socket 60, the T-shaped tongue 230 is first bent downward about the V-shaped groove 234, and then the T-shaped tongue 230 is snapped into the compartment 224 via the path 226, such that the shoulder 232 of the T-shaped tongue 230 abuts a lower surface of both protrusions 222 as shown in FIG. 4*a*. Alternatively, the T-shaped tongue 230 can be formed on the socket 60, and the flexible receiving means 220 can be formed, relative to the T-shaped tongue 230, on the receiving portion 12 of the connector 1 without limiting its function.

Figure 5A:
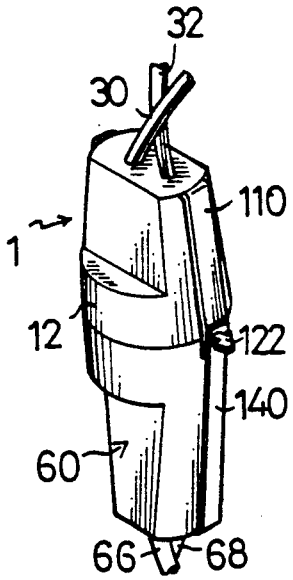
FIG. 5*a* shows the engagement of the connector and the conventional socket of FIG. 5.

FIGS. 5 and 5*a* show still another embodiment of a socket and bulb fastener. A hole 114 is centrally formed in the socket 60 for receiving the connector 1. A pair of T-shaped male members 120, each having a snapping head 122, are diametrically formed on an upper margin of a periphery of the socket 60. A first flexible tab 110 of insulating material is formed, relative to each T-shaped male member 120, on an outer periphery of the receiving portion 12 of the connector 1. A second flexible tab 140 of insulating material is formed, aligned with each T-shaped male member 120, on a lower margin of the periphery of the socket 60. A substantially rectangular slot 112 is formed on each first flexible tab 110 adjacent to a free end thereof. Similarly, a substantially rectangular slot 142 is formed on each second flexible tab 140 adjacent to a free end thereof. The slots 112 and 142 have a width slightly less than a maximum width of the snapping head 122 of the T-shaped male member 120.

As shown in FIG. 5*a*, after the connector 1 is inserted into the socket 60, the first flexible tabs 110 are bent downward, so that the slots 112 are snapped into corresponding T-shaped male members 120. The second flexible tabs 140 are then bent upward, so that the slots 142 are snapped into corresponding T-shaped male members 120, to provide a further secure engagement for the connector 1 and the socket 60. Alternatively, the T-shaped male member 120 can be formed on the connector 1 without affecting the securing function.

Figure 6:
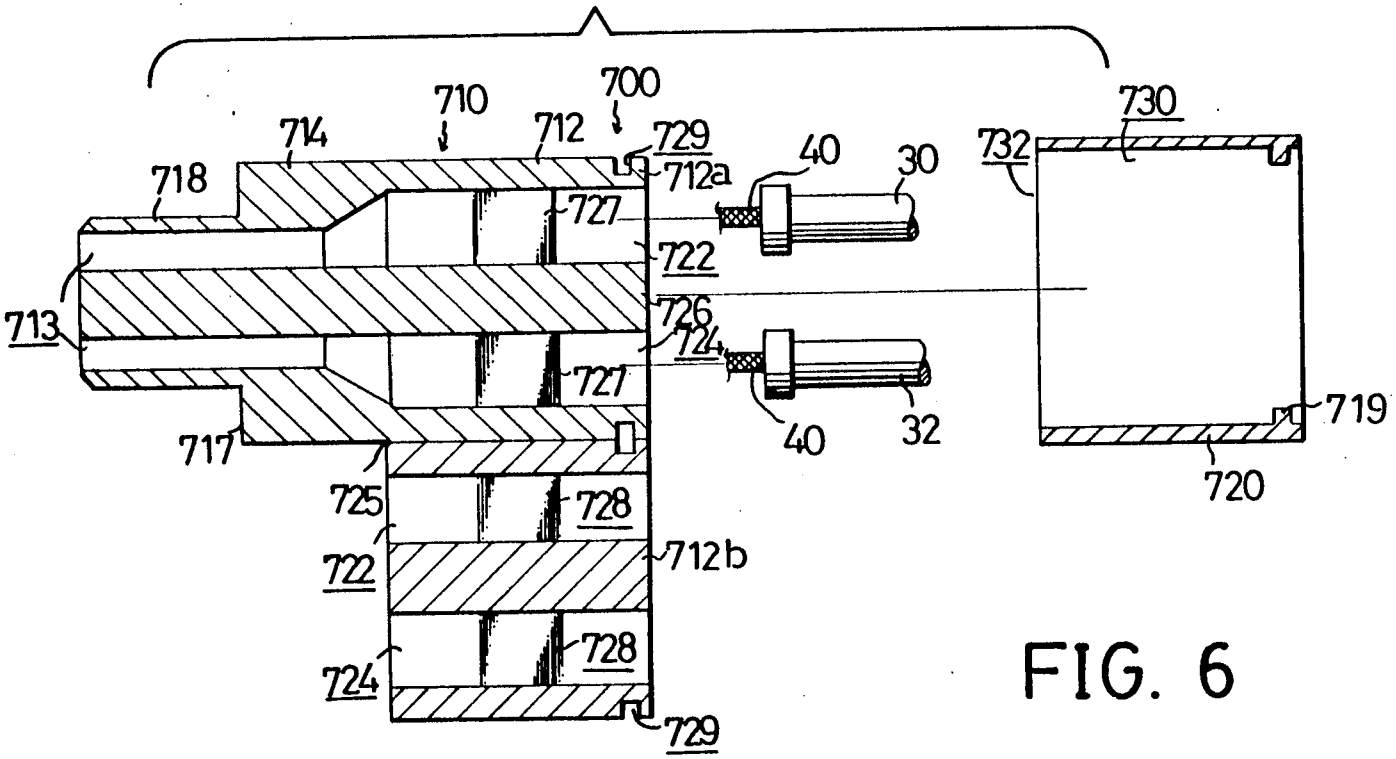
FIG. 6 is an exploded cross-sectional view of another embodiment of the connector in accordance with the present invention.
Figure 7:
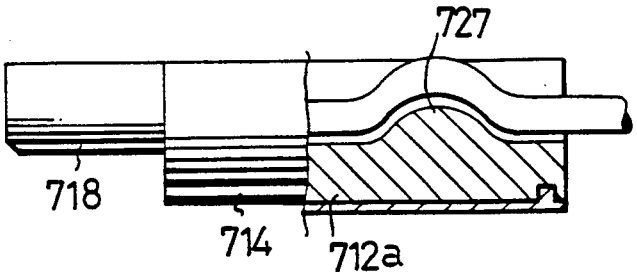
FIG. 7 is a cross-sectional view showing a conducting wire held in a wire-receiving portion of the connector of FIG. 6.

FIGS. 6 and 7 show another embodiment of the connector according to the present invention. In this embodiment, the connector 700 comprises an outer casing 720 and a socket-engaging portion 710 for engaging with a conventional socket 60.

The socket-engaging portion 710 includes an annular wire-holding portion 712, a first annular protrusion 714, and a second annular protrusion 718, in which a first end of the first annular protrusion 14 protrudes from one end of the wire-holding portion 712, and a first end of the second annular protrusion 718 protrudes from a second end of the first annular protrusion 714, thereby forming a shoulder 717 thereon. The wire-holding portion 712, the first annular protrusion 714, and the second protrusion 718 are integrally formed with insulating material.

The first annular protrusion 714 has an outer diameter the same as an outer diameter of the wire-holding portion 712, and the second annular protrusion 718 has an outer diameter less than the outer diameter of the first annular protrusion 714.

The wire-holding portion 712 includes two half casings 712*a* and 712*b*, each having two slots 722 and 724 separated by a wall 726 formed therebetween. One half casing 712*a* is formed integral with the first annular protrusion 714 and the second annular protrusion 716, and the other half casing 712*b*, is formed integral with the half casing 712*a* at one edge 725 thereof, such that the two half casings 20*a* and 20*b* are pivotable with respect to each other, as was the case of the two half casings 20*a* and 20*b* of the above-illustrated embodiment.

Two guiding channels 713 extend longitudinally in the first and second annular protrusions 714 and 718 to respectively communicate with the slots 722 and 724 of the half casing 712*a*. The two guiding channels 713 are separated by a wall 715 also extending longitudinally in the first and second annular protrusions 714 and 718. The annular hollow outer casing 720 has a compartment 730 therein and an opening 732 at one end thereof.

During assembly, the two conducting wires 30 and 32 are respectively placed into the slots 722 and 724 of the two half casings 712*a* and 712*b*, with the two contact blades 40 passing through respective guiding channels 713. The two half casings 712*a* and 712*b* are then closed. The two contact blades 40 are bent back around the outside of the second annular protrusion 718. The wire-holding portion 712 is inserted into the compartment 730 of the outer casing 720 via the opening 732. Accordingly, the assembled connector 700 is ready for engagement with the socket 60.

Figure 10:
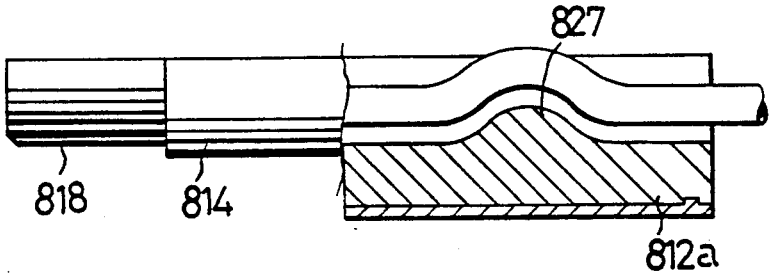
FIG. 10 is cross-sectional view showing a conducting wire held in a wire-receiving portion of the connector of FIG. 8.

Again, in the slots 722 and 724 of the two half casings 712*a* and 712*b*, in order to retain the conducting wires 30 and 32 in the wire-holding portion 712, a protrusion 727 is formed in slots 722 and 724 of the half casing 712*a*, and a corresponding recess 728 is formed in slots 722 and 724 of the other half casing 712*b* (see FIG. 10).

Again, an annular recess 729 is formed on an outer periphery of the wire-holding portion 712, and an annular flange 719 is formed on an inner periphery of the outer casing 720, so that when the wire holding portion 712 is inserted into the compartment 730 of the outer casing 720, the annular recess 729 engages with the annular flange 719 to securely retain the wire holding portion 721 in the outer casing 720.

Figure 8:
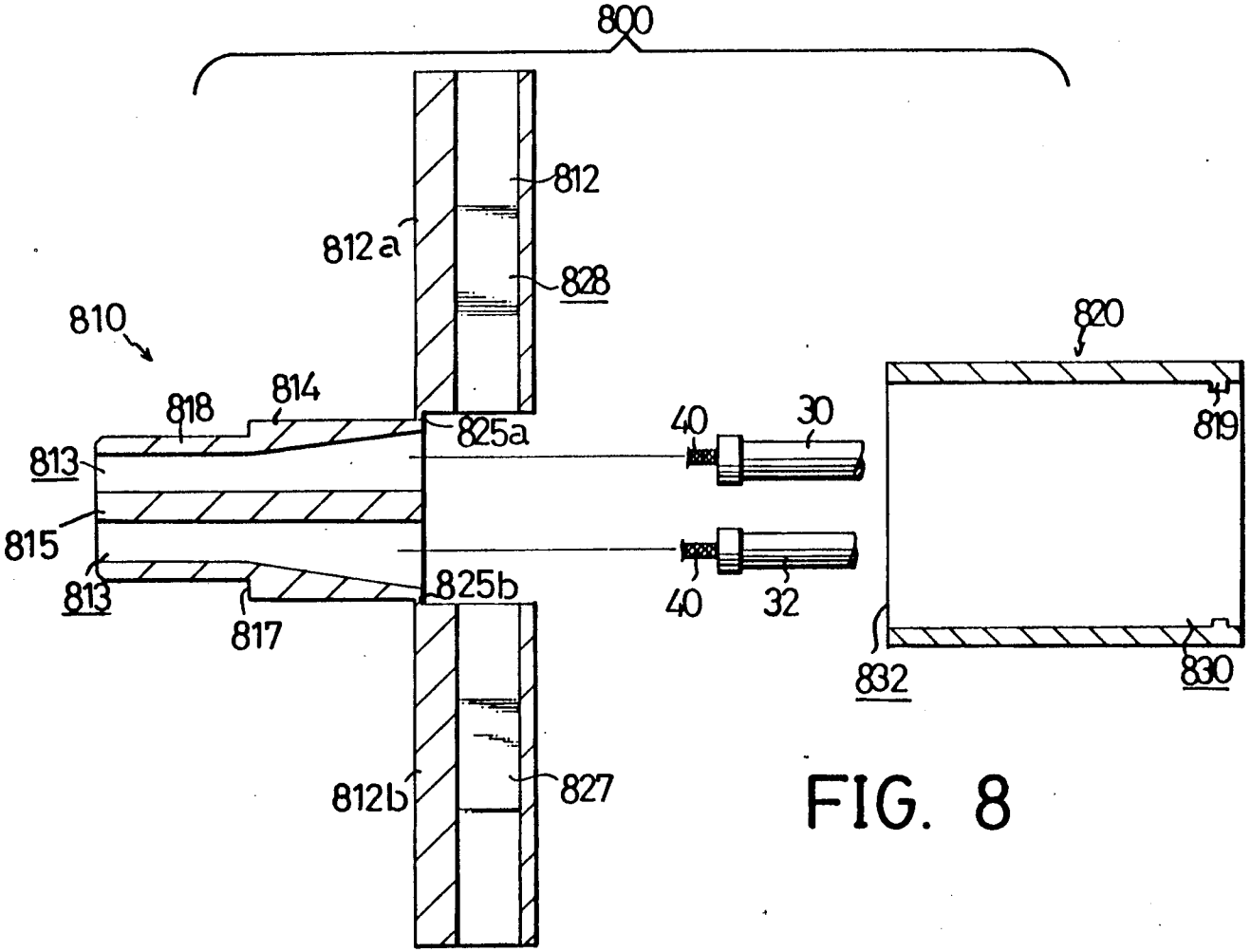
FIG. 8 is an exploded cross-sectional view of a still another embodiment of the connector in accordance with the present invention.
Figure 9:
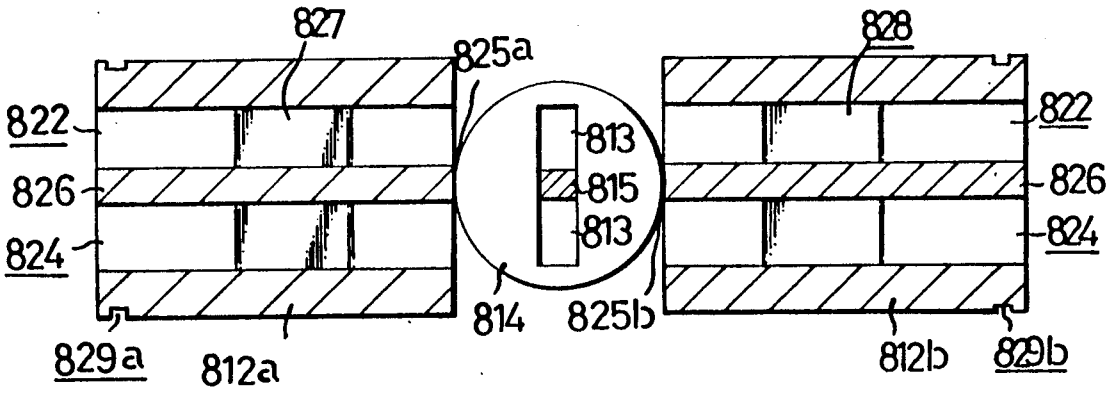
FIG. 9 is a top plan view of the connector of FIG. 8.

FIGS. 8 through 10 show still another embodiment of the connector according to the present invention. In this embodiment, the connector 800, similar to the previous described connector 700, includes a socket engaging portion 810 and an annular hollow outer casing 820 with a structure the same as that of the outer casing 720 of connector 700.

The socket-engaging portion 810 includes an annular wire-holding portion 812, a base portion 814, and an annular protrusion 818 protruding from a first end of the base portion 814, thereby forming a shoulder 817. The annular protrusion 818 has an outer diameter less than that of the base portion 814.

The wire-holding portion 812 includes two half casings 812*a* and 812*b*, each having two slots 822 and 824 separated by a wall 826 formed therebetween. The half casing 812*a* is integrally formed with a second end of the base portion 814 at an edge 825*a* thereof, and the other half casing 812*b* is integrally formed with the second end of the base portion 814 at another edge 825*b*, diametrically opposing the edge 825*a*, such that the two half casings 812*a* and 812*b* are respectively pivotable about the edges 825*a* and 825*b*. The base portion 814 is substantially equivalent to the first annular protrusion 714, and the annular protrusion 818 is substantially equivalent to the second protrusion 718. The two half casings 812*a* and 812*b* are substantially equivalent to the two half casings 712*a* and 712*b*, except for the axis they pivot about. All of these elements are of insulating material.

Two guiding channels 813 extend longitudinally in the base portion 814 and the annular protrusions 818 to respectively communicate with the slots 822 and 824 of the half casing 812*a* and 812*b* when the two half casings 812*a* and 812*b* are closed. The two guiding channels 813 are separated by a wall 815, also extending longitudinally in the base portion 814 and the annular protrusions 818. The outer casing 820 has a compartment 830 with an inner diameter the same as the outer diameter of the assembled casings 812*a* and 812*b* and an opening 832 at one end thereof.

During assembly, the two conducting wires 30 and 32 are respectively passed through respective guiding channels 813 with the contact blades 40 exposed at the outside of the annular protrusion 818. The two half casings are then closed with the two conducting wires 30 and 32 respectively received in the slots 822 and 824. The two contact blades 40 are bent back around the outside of the annular protrusion 818. The wire-holding portion 812 is then inserted into the compartment 830 of the outer casing 820 via the opening 832. Accordingly, the assembled connector 800 is ready for engagement with the conventional socket 60.

Similarly, in the slots 822 and 824 of the two half casings 812*a* and 812*b*, in order to retain the conducting wires 30 and 32 in the wire holding portion 812, a protrusion 827 is formed in the slots 822 and 824 of the half casing 812*a*, and a corresponding recess 828 is formed in the slots 822 and 824 of the other half casing 812*b*.

Similarly, a semi-circular recess 829*a* is formed on an outer periphery of the half casing 812*a*, and a corresponding semi-circular recess 829*b* is formed on an outer periphery of the half casing 812*b*. An annular flange 819 is formed on an inner periphery of the outer casing 820, such that when the wire holding portion 812 is inserted into the compartment 830 of the outer casing 820, the recesses 829*a* and 829*b* engage with the annular flange 819 to securely retain the wire holding portion 812 in the outer casing 820.

Figure 11:
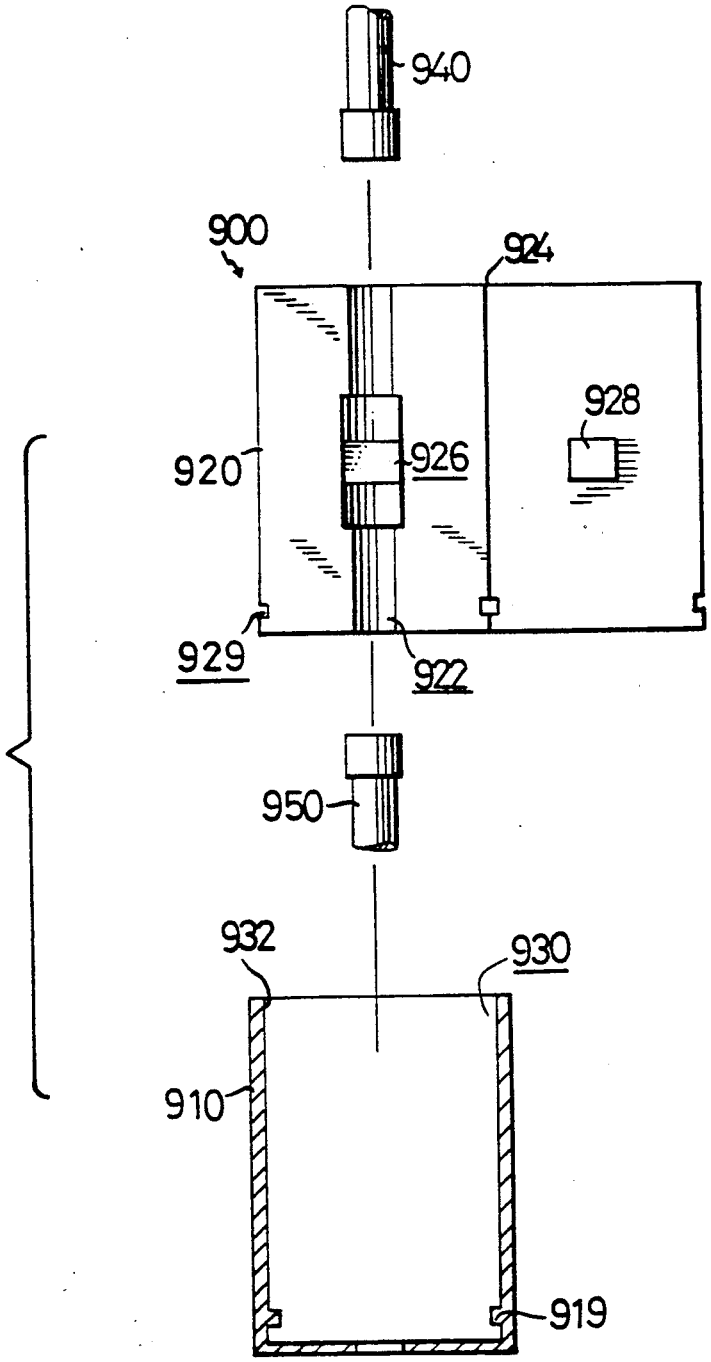
FIG. 11 shows yet another embodiment of the connector according to the present invention.

FIG. 11 shows yet another embodiment of the connector according to the present invention. In this embodiment, the connector 900 comprises a wire-holding portion 920 for receiving and holding wires 930 and 932, and an annular hollow outer casing 910.

The wire-holding portion 920 includes two half casings 920*a* and 920*b*. The half casing 920*a* is integral with the other half casing 920*b*, at one edge thereof 924 (i.e., the pivot axis), such that the two half casings 920*a* and 920*b* are pivotable with respect to each other. The outer casing 910 has a compartment 930 therein and an opening 932 at one end thereof.

An inner side of the half casing 920*a* has a groove 924 extending parallel to the pivot axis. A recess 926 is formed on the groove 924 of the half casing 920*a*, and a protrusion 928 is formed on an inner surface of half casing 920*b*.

During assembly, two conducting wires 940 and 950 are placed into the slot 922 of the half casing 920*a*, with the two conducting wires 940 and 950 contacting at the recess 926. The half casing 920*b* is then pivoted to form a completely closed structure. The wire-holding portion 920 is inserted into the compartment 930 of the outer casing 910 via the opening 932.

Figure 11A:
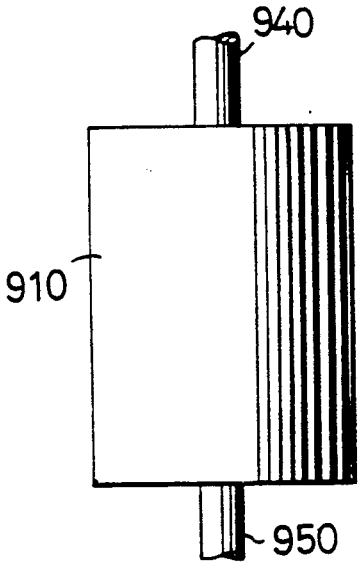
FIG. 11*a* shows an assembled connector of FIG. 11.

An annular recess 929 is formed on an outer periphery of the wire-holding portion 920, and an annular flange 919 is formed on an inner periphery of the outer casing 910, so that when the wire-holding portion 920 is inserted into the compartment 930 of the outer casing 910, the annular recess 929 engages with the annular flange 919 to securely retain the wire-holding portion 920 in the outer casing 910. FIG. 11*a* shows the assembled connector of this embodiment.

It is noted that the each of the two conducting wires 940 and 950 can be more than one conducting wire, and that these conducting wires would be received in the groove 922, contacting each other, as well as being held in the recess 926, by the provision of the protrusion 928.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A connector for electrically connecting a lighted decorative ornament in a first string of sockets for Christmas light strings to a second socket (60) of a second Christmas light string, the second socket (60) having two contacts (62 and 64) which are respectively electrically connected with one of two conducting wires (66 and 68) of the second Christmas light string at a first end thereof, a second end of each of the two contacts (62 and 64) being electrically connected to a contact blade (40), the contact blades (40) being respectively attached to one of two second conducting wire (30 and 32) which are secured in said connector, said connector (1) being characterized by comprising:

a wire-holding portion (20) for receiving and holding the two conducting wires (30 and 32) therein and a socket-engaging portion (10) for engaging with the second socket (60);

said wire-holding portion (20) including two half casings (20*a* and 20*b*) each having two slots (22 and 24) separated by a wall (26) formed therebetween, said two half casings (20*a* and 20*b*) being formed together at one edge (25) thereof so that said two half casings (20*a* and 20*b*) are pivotable with respect to each other;

said socket-engaging portion (10) including an annular hollow receiving portion (12), a first annular protrusion (14), and a second annular protrusion (18), said annular hollow receiving portion (12) having a compartment (122) therein for receiving said wire receiving portion (20), said first and second annular protrusions (14 and 18) being received in the second socket (60) when said connector engages with the second socket (60), said receiving portion having an opening (16) at a first end thereof through which said wire receiving portion (20) is passable into said compartment (122), a first end of said first annular protrusion (14) protruding from a second end of said receiving portion (12), a first end of said second annular protrusion (18) protruding from a second end of said first annular protrusion (14); and two guiding channels (13) extending longitudinally in said first and second annular protrusions (14 and 18) to communicate with said compartment (122) of said receiving portion (12), said two guiding channels (13) being separated by a wall (15) also extending longitudinally in said first and second annular protrusions (14 and 18), each said guiding channel (13) receiving one of said two contact blades (40) whose distal ends are bent back around an outside of said second annular protrusion (18) for engagement with the contacts (62 and 64) of the second socket (60).

2. A connector as claimed in claim 1, wherein said first annular protrusion (14) has an outer diameter less than an inner diameter of said annular hollow receiving portion (12), said second annular protrusion (18) having an outer diameter less than said outer diameter of said first annular protrusion (14).

3. A connector as claimed in claim 1, wherein said receiving portion (12), said first annular protrusion (14), and said second protrusion (18) are integrally formed of insulating material.

4. A connector as claimed in claim 1, wherein a protrusion (27) is formed in said slots (22 and 24) of said half casing (20*a*), and a corresponding recess (28) is formed in slots (22 and 24) of said other half casing (20*b*), said protrusion (27) and said recess (28) retain the conducting wires (30 and 32) in said wire-holding portion (20).

5. A connector as claimed in claim 1, wherein an annular recess (29) is formed on an outer periphery of said wire-holding portion (20), and an annular flange (19) is formed on an inner periphery of said receiving portion (12) of said socket-engaging portion (10) for engagement with said annular recess (29) when said wire-holding portion (20) is inserted into said compartment (122), for securely retaining said wire-holding portion (20) in said socket engaging portion (10).

6. A connector as claimed in claim 1, further comprising a socket and connector snap fastener comprising:

at least one T-shaped male member (120) having a snapping head (122) formed on an outer periphery of the second socket (60);

a corresponding number of tongues (130) formed, relative to each said T-shaped male member (120), on an outer periphery of said receiving portion (12) of said connector (1), a substantially rectangular slot (132), having a width slightly less than a maximum width of said snapping head (122) of said T-shaped male member (120), being formed on each said tongue (130) adjacent to a free end of each said tongue (130), a V-shaped groove (134) being formed on a lower side of each said tongue (130) at an end opposite to said free end and extending transversely to a length of each said tongue (130), each said slot (132) being engageable with each corresponding said T-shaped male member (120) by bending said tongue (130) downward about said V-shaped groove (134) and pushing each said tongue (130) against each corresponding said T-shaped male member (120), so that each respective said snapping head (122) is forced through each corresponding said slot (134).

7. A connector as claimed in claim 1, further comprising a socket and connector snap fastener comprising:

at least one T-shaped male member (120) having a snapping head (122) formed on an outer periphery of said receiving portion (12) of said connector (1);

a corresponding number of tongues (130) formed, relative to each said T-shaped male member (12), on an outer periphery of the second socket (60), a substantially rectangular slot (132), having a width slightly less than a maximum width of said snapping head (122) of said T-shaped male member (120), being formed on each said tongue (130) adjacent to a free end of each said tongue (130), a V-shaped groove (134) being formed on an upper side of each said tongue (130) at an end opposite to said free end and extending transversely to a length of each said tongue (130), each said slot (134) being engageable with each corresponding said T-shaped male member (120) by bending each said tongue (130) upward about said V-shaped groove (134) and pushing each said tongue (130) against each corresponding said T-shaped male member (120), so that each respective said snapping head (122) is forced through each corresponding said slot (132).

8. A connector as claimed in claim 1, further comprising a socket and connector snap fastener comprising:

at least one substantially T-shaped tongue (230) formed on an outer periphery of the second socket (60), each T-shaped tongue (230) having a shoulder (232) formed adjacent to a free end of said T-shaped tongue (230), a V-shaped groove (234) being formed on an upper side of each said T-shaped tongue (230) at an end opposite to said free end of said tongue and extending transversely across a length of each said tongue (230);

a corresponding number of flexible receiving means (220) formed, relative to each said T-shaped tongue (230), on an outer periphery of said receiving portion (12) of said connector (1), each said receiving means (220) comprising two mirror-imaged L-shaped protrusions (222) which together form a compartment (224) and a path (226) slightly less wide than a width of said T-shaped tongue (230), each said T-shaped tongue (230) being engageable with each corresponding receiving means (220) by bending said T-shaped tongue (230) upward about said V-shaped groove (234) and snapping each said T-shaped tongue (230) into said compartment (224) via a corresponding path (226), so that said shoulder (232) of each said T-shaped tongue (230) abuts an upper surface of both said protrusions (222).

9. A connector as claimed in claim 1, further comprising a socket and connector snap fastener comprising:

at least one substantially T-shaped tongue (230) formed on an outer periphery of said receiving (12) of said connector (1), each T-shaped tongue (230) having a shoulder (232) formed adjacent to a free end of said T-shaped tongue (230), a V-shaped groove (234) being formed on a lower side of said T-shaped tongue (230) at an end opposite to said free end of said tongue (230) and extending transversely across a length of each said tongue (230);

a corresponding number of flexible receiving means (220) formed, relative to each said T-shaped tongue (230), on an outer periphery of the second socket (60), each said receiving means (220) comprising two mirror-imaged L-shaped protrusions (222) which together form a compartment (224) and a path (226) slightly less wide than a width of said T-shaped tongue (230), each said T-shaped tongue (230) being engageable with each corresponding receiving means (220) by bending said T-shaped tongue (230) downward about said V-shaped groove (234) and snapping each said T-shaped tongue (230) into said compartment (224) via a corresponding said path (226), so that said shoulder (232) of each said T-shaped tongue (230) abuts a lower surface of both said protrusions (224).

10. A connector as claimed in claim 1, further comprising a socket and connector snap fastener comprising:

a pair of T-shaped male member (120) each having a snapping head (122) being diametrically formed on an outer periphery of the second socket (60), a pair of first flexible tabs (110) being formed, relative to said T-shaped male members (120), on an outer periphery of said receiving portion (12) of said connector (1), a pair of second flexible tabs (140) being formed, relative to said T-shaped male members (120), on an outer periphery of the second socket (60), a substantially rectangular slot (112 and 114) being formed on each said first and second flexible tab (110 and 140) adjacent to a free end thereof, each said slot (112 and 142) having a width slightly less than a maximum width of said snapping head (122) of said T-shaped male member (120).

11. A connector as claimed in claim 1, further comprising a socket and connector snap fastener comprising:

a pair of T-shaped male member (120) each having a snapping head (122) being diametrically formed on an outer periphery of said receiving portion (12) adjacent to said first protrusion (14), a pair of first flexible tabs (110) being formed, relative to said T-shaped male members (120), on an upper portion of said outer periphery of said receiving portion (12) of said connector (1), a pair of second flexible tabs (140) being formed, relative to said T-shaped male members (120), on an outer periphery of the second socket (60), a substantially rectangular slot (112 and 114) being formed on each said first and second flexible tab (110 and 140) adjacent to a free end thereof, each said slot (112 and 142) having a width slightly less than a maximum width of said snapping head (122) of said T-shaped male member (120).

12. A connector for electrically connecting a lighted decorative ornament in a first string of sockets for Christmas light strings to a second socket (60) of a second Christmas light string, the second socket (60) having two contacts (62 and 64) which are respectively electrically connected with one of two conducting wires (66 and 68) of the second Christmas light string at a first end thereof, a second end of each of the two contacts (62 and 64) being electrically connected to a contact blade (40), the contact blades (40) being respectively attached to one of two second conducting wire (30 and 32) which are secured in said connector, said connector (700) being characterized by comprising:

a socket-engaging portion (710) for engaging with the second socket (60), said socket engaging portion (710) including an annular wire holding portion (712), a first annular protrusion (714), and a second annular protrusion (718), said first and second annular protrusions (714 and 718) being received in the second socket (60) when said connector engages with the second socket (60), a first end of said first annular protrusion (714) protruding from a first end of said wire-holding portion (712), a first end of said second annular protrusion (718) protruding from a second end of said first annular protrusion (714);

said wire-holding portion (712) including two half casings (712*a* and 712*b*) each having two slots (722 and 724) separated by a wall (726) formed therebetween for respectively receiving and holding the two conducting wires (30 and 32) therein, one half casing (712*a*) being integral with said first annular protrusion (714) and said second annular protrusion (716), and the other half casing (712*b*) being formed integral with said half casing (712*a*) at one edge (725) thereof such that said other half casings (712*b*) is pivotable with respect to said half casings (712*a*);

two guiding channels (713) extending longitudinally in said first and second annular protrusions (714 and 718) to respectively communicate with said slots (722 and 724) of said half casing (712*a* and 712*b*), said guiding channels (713) being separated by a wall (715) also extending longitudinally in said first and second annular protrusions (714 and 718), each said channel (713) receiving one of the contact blades (40) whose distal ends are bent back around an outside of said second annular protrusion (718) for engagement with the contacts (62 and 64) of the second socket (60); and an annular hollow outer casing (720) having a compartment (730) therein for receiving said wire-receiving portion (712) and an opening (732) at one end thereof through which said wire-receiving portion (712) is passable into said compartment (730).

13. A connector as claimed in claim 12, wherein a protrusion (727) is formed in said slots (722 and 724) of said half casing (712*a*), and a corresponding recess (728) is formed in said slots (722 and 724) of said other half casing (712*b*), said protrusion (727) and said recess (728) retain the conducting wires (30 and 32) in said wire-receiving portions (712).

14. A connector as claimed in claim 12, wherein said wire holding portion (712), said first annular protrusion (714), and said second protrusion (718) are integrally formed of insulating material.

15. A connector as claimed in claim 12, wherein said first annular protrusion (714) has an outer diameter the same as an outer diameter of said wire holding portion (712), and said second annular protrusion (718) has an outer diameter less than the outer diameter of said first annular protrusion (714).

16. A connector as claimed in claim 12, wherein an annular recess (729) is formed on an outer periphery of said wire-holding portion (712), and an annular flange (719) is formed on an inner periphery of said outer casing (720) for engagement with said annular recess (729) when said wire holding portion (712) is inserted into said compartment (730), said recess (729) and said flange (719) securely retain said wire-holding portion (712) in said outer casing (720).

17. A connector for electrically connecting a lighted decorative ornament in a first string of sockets for Christmas light strings to a second socket (60) of a second Christmas light string, the second socket (60) having two contacts (62 and 64) which are respectively electrically connected with one of two conducting wires (66 and 68) of the second Christmas light string at a first end thereof, a second end of each of the two contacts (62 and 64) being electrically connected to a contact blade (40), the contact blades (40) being respectively attached to one of two second conducting wire (30 and 32) which are secured in said connector, said connector (800) being characterized by comprising:

a socket-engaging portion (810) for engaging with the second socket (60), said socket engaging portion (810) including an annular wire-holding portion (812), a base portion (814), and an annular protrusion (818) protruding from a first end of said base portion (814), said annular protrusion (818) having an outer diameter less than that of said base portion (814), said base portion (814) and said annular protrusion (818) being received in said second socket (60) when said connector engages with the second socket (60);

said wire-holding portion (812) including two half casings (812*a* and 812*b*) each having two slots (822 and 824) separated by a wall (826) formed therebetween, one said half casing (812*a*) being integrally formed with a second end of said base portion (814) at an edge (825*a*) thereof and the other half casing (812*b*) being integrally formed at said second end of said base portion (814) at an edge (825*b*) diametrically opposed to said edge (825*b*), so that said two half casings (812*a* and 812*b*) are respectively pivotable about the edges (825*a* and 825*b*);

two guiding channels (813) extending longitudinally in said base portion (814) and said annular protrusions (818) to respectively communicate with said slots (822 and 824) of said half casing (812*a* and 812*b*) when said two half casings (812*a* and 812*b*) are in a closed position, said guiding channels (813) being separated by a wall (815) also extending longitudinally in said base portion (814) and said annular protrusions (818), each said channel (813) receiving one of the contact blades (40) whose distal ends are bent back around an outside of said second annular protrusion (818) for engagement with said two contacts (62 and 64) of the second socket (60); and an annular hollow outer casing (820) having a compartment (830) therein for receiving said wire-receiving portion (812) and an opening (832) at one end thereof through which said wire-receiving portion (712) is passable into said compartment (830).

18. A connector as claimed in claim 17, wherein a protrusion (827) is formed in said slots (822 and 824) of said half casing (812*a*), and a corresponding recess (828) is formed in said slots (822 and 824) of said other half casing (812*b*), said protrusion (827) and said recess (828) retain the conducting wires (30 and 32) in said wire-holding portion (812).

19. A connector as claimed in claim 17, wherein a semi-circular recess (829*a*) is formed on an outer periphery of said half casing (812*a*), a semi-circular recess (829*b*) is formed on an outer periphery of said other half casing (812*b*), so that an annular recess is formed when said said tow half casings (812*a* and 812*b*) are assembled, and an annular flange (819) is formed on an inner periphery of said outer casing (820) for engagement with said annular recess (829*a* and 829*b*) when said wire holding portion (812) is inserted into said compartment (830), for securely retaining said wire holding portion (812) in said outer casing (820).

20. A connector for connecting wires comprising:

a wire-holding portion (920) for receiving and holding a first and second wires to be connected, said wire-holding portion (920) including two half casings (920*a* and 920*b*), said half casing (920*a*) being integral with the other half casing (920*b*) at one edge (924) thereof which defines a pivot axis, so that said two half casings (920*a* and 920*b*) are pivotable with respect to each other about said pivot axis, said half casing (920*a*) having a groove (924), formed on an inner surface thereof and extending parallel to said pivot axis, for guiding and receiving the first and second conducting wires, a recess (926) being formed in said groove (924) at which said first and second conducting wires contact, a protrusion (928) being formed, relative to said recess (926), on an inner surface of said other half casing (920*b*), for securely retaining the first and second conducting wires in said recess (926) in a contact manner;

an outer casing (910) having a compartment (930) therein for receiving said wire-receiving portion (920) and an opening (932) at one end thereof through which said wire-receiving portion (920) is passable; and an annular recess (929) being formed on an outer periphery of said wire-holding portion (920), and an annular flange (919) being formed on an inner periphery of said outer casing (910), for engagement with said annular recess (929) when said wire holding portion (920) is inserted into said compartment (930), for securely retaining said wire-holding portion (920) in said outer casing (910).

* * * * *